US007708046B1

(12) United States Patent
Pease

(10) Patent No.: US 7,708,046 B1
(45) Date of Patent: May 4, 2010

(54) AWNING WIND DEFLECTOR

(76) Inventor: Les E. Pease, P.O. Box 631, O'Brien, OR (US) 97534

( * ) Notice: Subject to any disclaimer, the term of this patent is extended or adjusted under 35 U.S.C. 154(b) by 317 days.

(21) Appl. No.: 11/975,093

(22) Filed: Oct. 16, 2007

(51) Int. Cl.
*E04F 10/06* (2006.01)

(52) U.S. Cl. ..... 160/66; 160/67

(58) Field of Classification Search ..... 160/67, 160/66, 45; 285/415, 236; 138/88.11, 88.12
See application file for complete search history.

(56) References Cited

U.S. PATENT DOCUMENTS 3,873,135 A * 3/1975 Kreitzberg ..... 285/148.26
4,530,389 A 7/1985 Quinn et al.
4,733,683 A 3/1988 Pozzi
4,924,895 A 5/1990 Ballie
5,192,111 A 3/1993 Hanemaayer
6,213,685 B1 * 4/2001 Ingalls ..... 405/129.6
6,782,936 B1 8/2004 Girard et al.
7,044,189 B1 * 5/2006 Hanna ..... 160/66

* cited by examiner

*Primary Examiner*—Blair M. Johnson
(74) *Attorney, Agent, or Firm*—Gerald D Haynes

(57) ABSTRACT

An awning wind deflector adapted for deflecting wind around and away from a rolled up awning structure attached to a recreation vehicle. The wind deflector comprising a disk-shaped flange at one end and an elongated tubular stem at the other end. The wind deflector is mounted at an end of the rolled up awning structure, wherein the flange having a sloping front face faces the head winds. The wind deflector includes an elongated radial slit for mounting over the rolled up structure by flexing the slit and clamping the wind deflector by a hose clamp around the elongated tubular stem.

6 Claims, 4 Drawing Sheets

FIG. 5
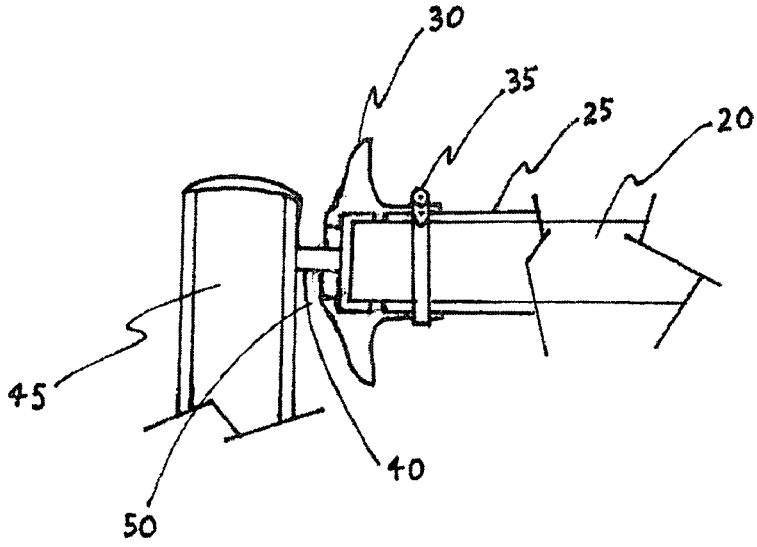
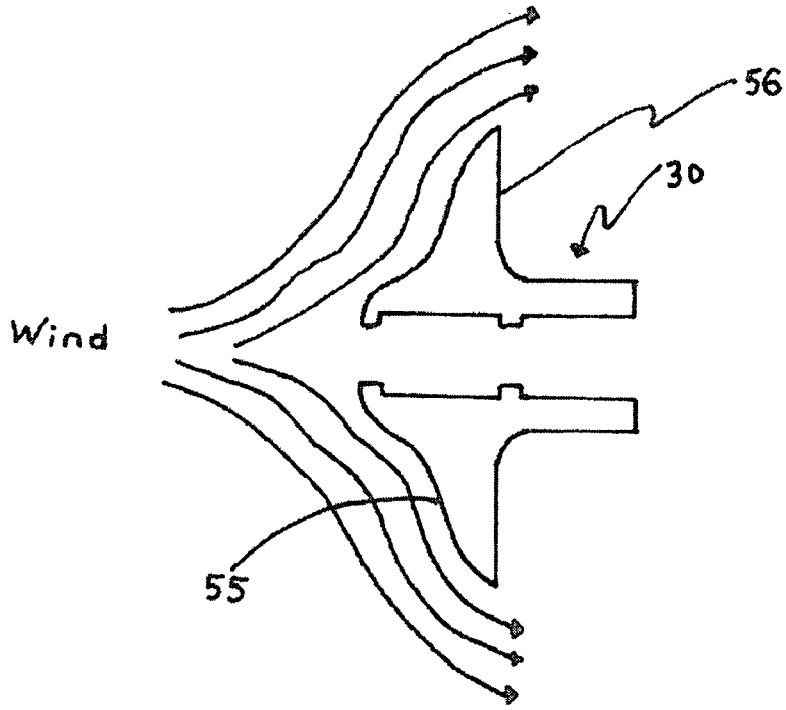
FIG. 6

AWNING WIND DEFLECTOR

BACKGROUND OF THE INVENTION

1. Field of the Invention

This invention relates to a removably attached wind deflector for protecting a rolled up awning structure mounted on to a side of a recreational vehicle (RV) from head winds, while traveling at high speed. The shape and the flexibility of the deflector structure causes the wind flow smoothly away from the rolled awning without disrupting and blow out of the awning flap 2. Description of the Related Art Rolled up awnings in general are well known in the art for use in canopies recreation vehicles for providing shade, space and the pleasure of enjoying outdoor environment. Presently, there is no specific device or apparatus which can provide protection against blow out of the rolled up awning flap. Usually a wrapper is used to wrap around the rolled up awning to protect from head winds.

A further problem is that when traveling at high speed of about 75 mph the fittings holding the awning are subjected to intermittent pressure and impact which results in wear and tear to the fittings and the supporting structure.

U.S. Pat. No. 6,782,936, issued Aug. 31, 2004 to Girard et al, describes a protective frame cover for enclosing the roller and awning material and sealing with the header in order to prevent wing-generated noise during driving.

U.S. Pat. No. 5,192,111, issued Mar. 9, 1993 to Hanemaayer, describes an awning having a recess into which the awning material is enclosed in a fully retracted position.

U.S. Pat. No. 4,530,389, issued Jul. 23, 1985 to Quinn et al is drawn to a roll control mechanism of a retractable awning assembly.

U.S. Pat. No. 4,924,895, filled May 15, 1990 to Bailie, describes an awning cover for protecting the fabric of the awning when rolled into the stored portion of the awning, therebetween to hold the awning cover in place.

None of the above inventions and patents, taken either singly or in combination, is seen to describe the instant invention as claimed. Thus a roll up awning wind deflector for protecting the awning and the attachment structure from the wind gusts is desired.

SUMMARY OF THE INVENTION

In accordance with the present invention, a wind deflector is removably mounted at the windward end of the rolled up awning for deflecting wind around and away from a recreation vehicle rolled up awning. The wind deflector comprises a disk-shaped flange at one end and an elongated stem at the other end. The wind deflector having a circular opening therethrough for slidably engaging around the rolled up awning structure. The flanged end of the wind deflector having a sloping flange facing the windward direction for smoothly diverting the wind away from the recreation vehicle.

Additionally, the disk-shaped flanged structure of the wind deflector includes a vertical flat edge for abutting against the body of the recreational vehicle for providing stability to the wind deflector structure.

It is an object of the invention to provide a longitudinal radial slit along the wind deflector structure for easily and removably mounting the wind deflector around the rolled up awning structure.

It is another object of the invention to fixedly attach the wind deflector structure to the rolled up awning structure by the use of a stainless steel hose clamp, around the elongated stem of the wind deflector by tightening screws which would simply require a screw driver as additional tool.

It is still another object of the invention to use flexible material for the wind deflector structure, such as urethane and/or polyurethane elastomer. This flexible material is of light weight and provides a smooth flow around the deflector structure due its flexibility and reduces the noise generated by the head winds while traveling at high speeds.

Additionally the disk-shaped flanged portion comprises an internal circular groove around the circular opening for gripping cap portion at the end of the rolled up awning structure.

The summary of the present invention will become readily apparent upon further review of the following specifications and drawings.

BRIEF DESCRIPTION OF THE DRAWINGS

FIG. 5 illustrates a side view of my present invention mounted around the rolled up awning structure in the locked travel position.

FIG. 6 illustrates the flow of eddies around the wind deflector structure of the preferred embodiment of my invention.

DETAILED DESCRIPTION OF THE INVENTION

Figure 1:
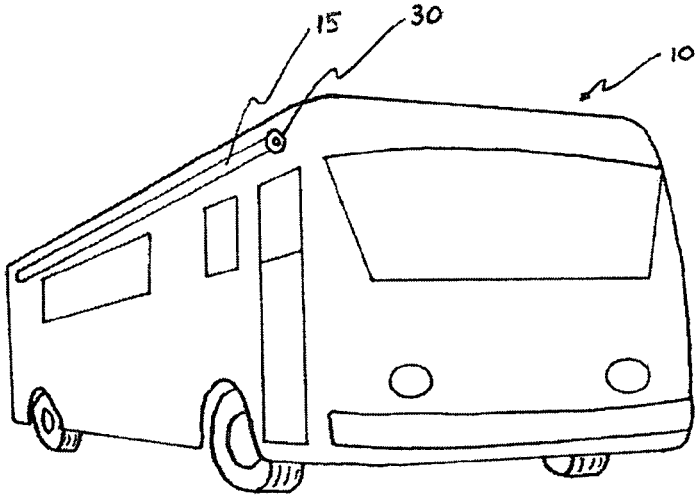
FIG. 1 illustrates a recreational vehicle with an externally mounted rolled up awning structure having a wind deflector structure mounted thereon according to an embodiment of my invention.

My invention provides an apparatus for diverting wind from the leading edge of the awning, preventing air from entering between the canvas and the roller tube. Referring now to FIGS. 1-6 of the drawings wherein I designate identical parts and components by the same reference numerals throughout the specification. FIG. 1 illustrates the location and the positioning of the wind deflector structure attached at the windward end of the rolled up awning structure mounted on to the side of the recreational vehicle.

Figure 2:
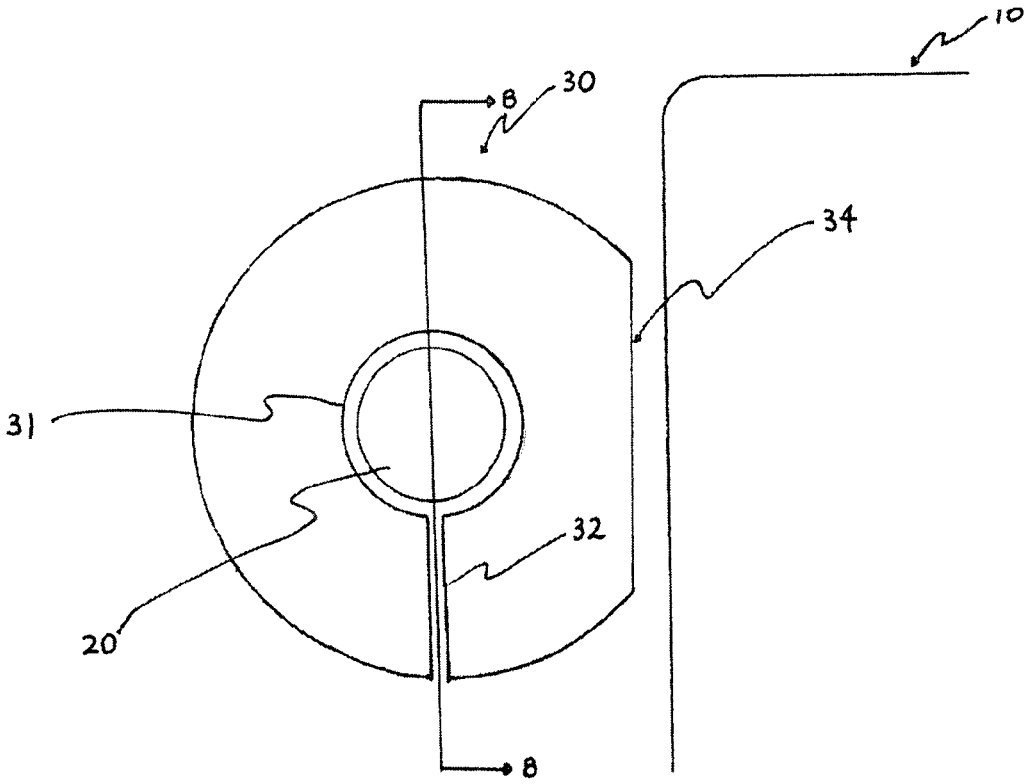
FIG. 2 illustrates a front view of the wind deflector structure facing the windward direction, according to an embodiment of my invention

Now referring to FIG. 2, I illustrate a front view (showing the section taken along A-A of FIG. 3) of my invention the wind deflector 30 having a circular shape with a flat edge 34 for abutting against the side of the RV 10. The wind deflector comprising a circular opening 31 for mounting around the rolled up awning structure 15 and a radial slit 32 for ease of mounting on to the rolled up awning 15 by flexed opening the radial slit 32.

Figure 3:
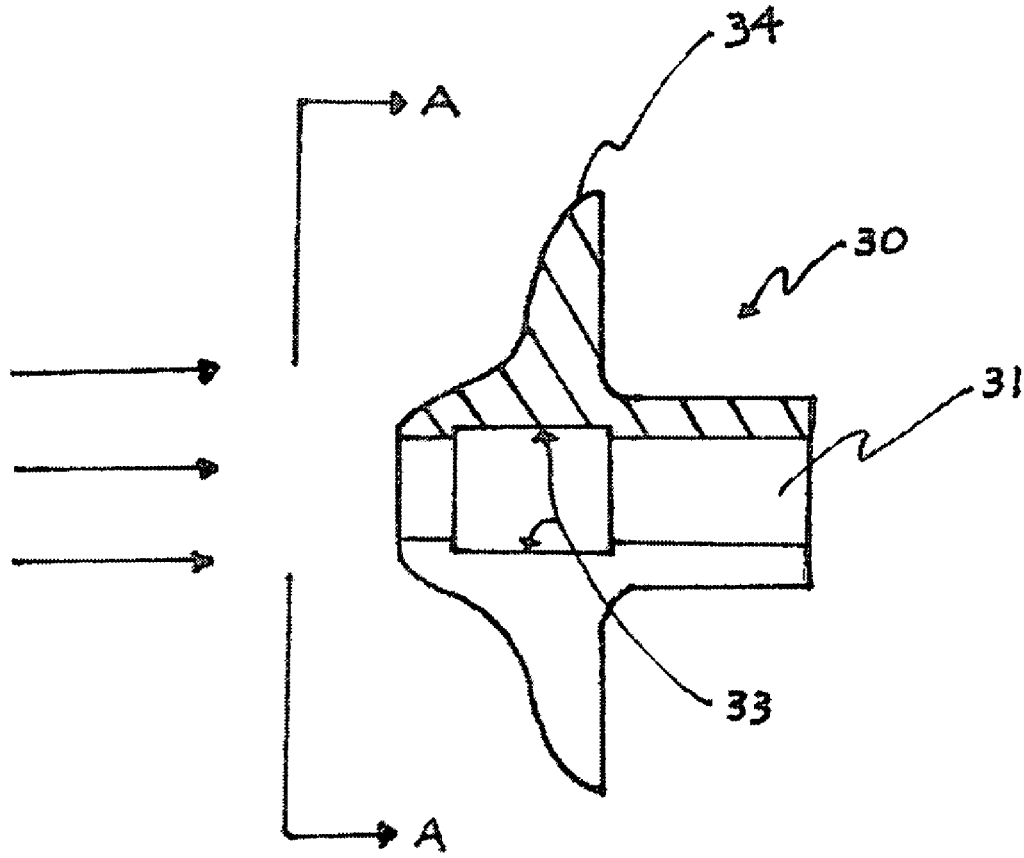
FIG. 3 illustrates a sectional side view of my present invention properly installed, facing forward into the wind for traveling.

Now referring to FIG. 3, I illustrate a side view showing the section taken along B-B of FIG. 2, includes an inner circumferential groove 33 for snuggly fitting over the cap 50 of the rolled up awning as illustrated in FIG. 5. The flange 34 is provided with a smooth sloping cross-section having a thicker section around and at the opening 31 for providing rigidity to the deflector structure and a thinner section at the outer circumferential edge for deflecting the head winds away smoothly from the RV.

Figure 4:
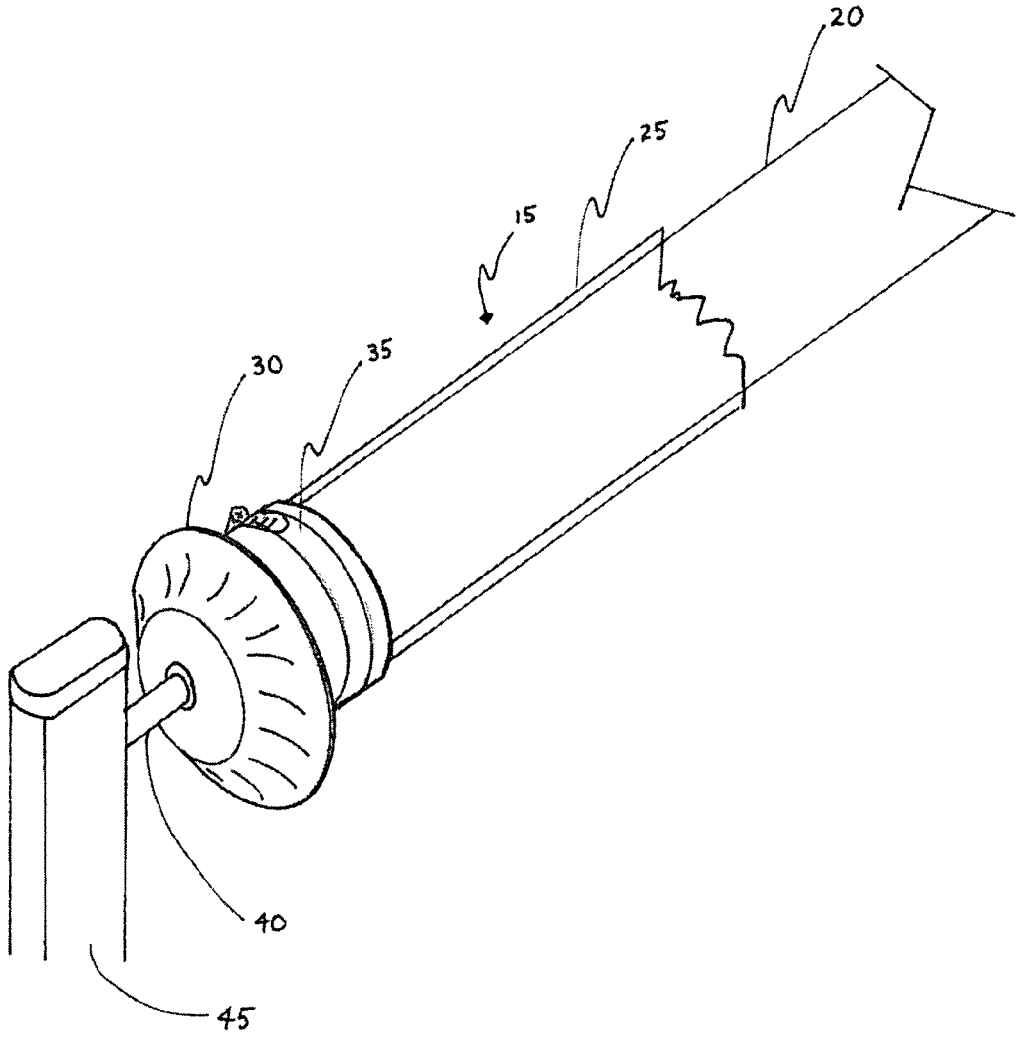
FIG. 4 illustrates a perspective view showing my present invention from a side view.

Now referring to FIG. 4, I illustrate a perspective view showing my present invention from a side view. This view illustrates the positioning of the wind deflector 30 with respect to roller 20, awning fabric 25, a clamp 35, a rod 40 for supporting the rolled up awning structure and bracket 45 attached to the body of the RV.

Now referring to FIG. 5, I illustrate a detailed view showing the mounting of the wind deflector on to the rolled up awning. The flexible wind deflector having a inner circumferential groove 33 which fits over the end cap 50 of the rolled up awning structure and the stem portion of the wind deflector 30 extends over and around the rolled awning fabric 25 which is wound over the roller 20. A clamp 35 as shown positioned around the stem of the wind deflector for fixedly attaching the wind deflector to the rolled up awning.

Now referring to FIG. 6, I illustrate the probable flow of eddies around the wind deflector structure 30, as how the eddies flow around the windward face 55 and away from the leeward face 56 due to head winds encountered while traveling at high speeds.

Those skilled in the art will appreciate that I have described a particular embodiment of my invention. Alteration, modification and improvements thereto will readily occur to those skilled in the art. Accordingly, the foregoing description is by way of example only and the invention is to be limited by the following claim and equivalents thereto.

I claim:

1. An awning wind deflector adapted for deflecting wind around and away from a rolled up awning structure having a windward end and a leeward end attached to a recreation vehicle, comprising:

a body having a disk-shaped flange at one end and an elongated tubular stem at the other end, a circular opening through the body from one end to the other therethrough;

the disk-shaped flange comprises a wider portion sloping to a more narrow portion to form a deflecting surface; and a major portion of a perimeter of the wider portion comprising an annular surface and the remaining portion of the perimeter of the wider portion defining a flat side planar surface; and the circular portion body having a radial slit extending from outside the body to the circular opening from one end to the other end, the walls of the slit being parallel to the flat side planar surface portion; and a hose clamp for fixedly clamping the wind deflector stem mounted over said rolled up awning structure;

wherein mounting of the flanged end of the wind deflector at the windward end of said rolled up awning structure attached to a recreational vehicle by flexed opening the radial slit and clamping around the elongated tubular stem, the wind deflector thereby deflecting wind around and away from the awning roller tube when the recreational vehicle is moving in a forward direction.

2. The wind deflector of claim 1 wherein the wind deflector comprises a material selected from the group consisting of urethane, polyurethane elastomer or other flexible material.

3. The wind deflector of claim 1, wherein the flat side portion of the disk-shaped flange is adapted to abut against an exterior wall of said recreational vehicle when mounted over the windward end of said rolled up awning structure.

4. The wind deflector of claim 1, wherein sloping deflecting surface is defined as a front face facing the head wind while traveling.

5. The wind deflector of claim 4 further includes an internal groove around the circular opening for gripping an end cap of said rolled up awning structure.

6. The wind deflector of claim 1, wherein the hose clamp is made of stainless steel.

* * * * *